US007311089B2

(12) United States Patent
Balsdon

(10) Patent No.: US 7,311,089 B2
(45) Date of Patent: Dec. 25, 2007

(54) HIGH FLOW, LOW VACUUM CARBON CANISTER PURGE VALVE

(75) Inventor: David William Balsdon, Chatham (CA)

(73) Assignee: Siemens VDO Automotive Canada Inc., Chatham (CA)

( * ) Notice: Subject to any disclaimer, the term of this patent is extended or adjusted under 35 U.S.C. 154(b) by 0 days.

(21) Appl. No.: 11/585,596

(22) Filed: Oct. 24, 2006

(65) Prior Publication Data

US 2007/0113833 A1 May 24, 2007

Related U.S. Application Data

(60) Provisional application No. 60/732,031, filed on Nov. 1, 2005.

(51) Int. Cl.
*F02M 33/04* (2006.01)
*F02M 33/02* (2006.01)

(52) U.S. Cl. ..... 123/520; 123/519

(58) Field of Classification Search ..... 123/520, 123/519, 518, 516, 198 E; 73/118.1
See application file for complete search history.

(56) References Cited

U.S. PATENT DOCUMENTS 4,086,897 A * 5/1978 Tamura et al. ..... 123/520
4,308,841 A * 1/1982 Kingsley ..... 123/520
4,527,532 A * 7/1985 Kasai et al. ..... 123/520
5,188,141 A * 2/1993 Cook et al. ..... 137/112
5,347,971 A 9/1994 Kobayashi et al.
5,553,577 A * 9/1996 Denz et al. ..... 123/198 D
5,967,183 A 10/1999 Detweiler et al.
5,970,958 A * 10/1999 DeLand et al. ..... 123/520
6,371,089 B1 4/2002 Matsuoka et al.

FOREIGN PATENT DOCUMENTS

JP 05039758 A 2/1993

* cited by examiner

*Primary Examiner*—Mahmoud Gimie

(57) ABSTRACT

A technique is provided for purging an adsorption canister in a fuel tank vent system. The technique provides a relatively high purge flow under conditions wherein the intake manifold vacuum is relatively low. A sonic nozzle is placed in the purge line between the existing purge valve and the adsorption canister. The sonic nozzle includes a tap at its throat for producing a vacuum in response to flow in the purge line. The vacuum is used to control a vacuum operated diaphragm valve in a parallel purge line. The system therefore supplements purge flow through the adsorption canister to the intake manifold.

19 Claims, 6 Drawing Sheets

HIGH FLOW, LOW VACUUM CARBON CANISTER PURGE VALVE

CROSS REFERENCE TO RELATED APPLICATIONS

This application claims the benefit of U.S. Provisional Patent Application Ser. No. 60/732,031 entitled "High Flow, Low Vacuum Carbon Canister Purge Valve," filed on Nov. 1, 2005, the contents of which are hereby incorporated by reference herein in their entirety.

FIELD OF THE INVENTION

The present invention relates generally to the field of fuel system emissions control, and more particularly, to techniques and systems for purging an adsorption canister used to remove hydrocarbon pollutants from the vent effluent of a fuel tank.

BACKGROUND OF THE INVENTION

Conventional fuel systems for vehicles with internal combustion engines may include a canister that accumulates fuel vapor from the headspace of the fuel tank. The canister typically contains an adsorption medium such as activated charcoal that adsorbs hydrocarbon pollutants in the vented fuel vapor before the vent effluent is released into the atmosphere.

Activated charcoal removes organic pollutants by adsorption, a process whereby the pollutants are attracted to the relatively large surface area of the charcoal particles. The charcoal becomes saturated over time, however, and the canister must be purged to remove the pollutants so that more may be adsorbed.

In a typical automotive fuel system, the charcoal canister is purged by using intake manifold vacuum to draw outside air through the canister. The volatile organic compounds that are purged from the adsorption medium in the canister are transferred to the engine combustion chambers for combustion.

Hydrocarbon pollutants accumulate in the charcoal canister during periods when the engine is off and the vehicle is not in use. During those periods, it is not possible to purge the canister because no manifold vacuum is available. It is therefore important that the canister be purged to the greatest extent possible during those times when the engine is running, and manifold vacuum is available.

Various government regulatory agencies, such as the U.S. Environmental Protection Agency and the Air Resources Board of the California Environmental Protection Agency, have promulgated standards related to limiting fuel vapor released into the atmosphere. To comply with those standards, the adsorption canister must be purged regularly to free it from accumulated pollutants. In that way, it is assured that hydrocarbons are efficiently removed fuel tank vapors vent to atmosphere.

In a typical fuel tank ventilation system 100, shown in FIG. 1, vapors from a fuel tank 110 are passed through an adsorption canister 120 containing activated charcoal, and are vented 130 to atmosphere. A dust filter (not shown) is typically used on the vent 130 to prevent particulate contaminants from entering the system. Vapors are caused to flow from the fuel tank out the vent by natural pressure in the tank caused by temperature increases and volatility of the fuel.

A canister purge valve 140 is opened to purge the adsorption canister 120 with outside air from the vent 130. When an engine control unit (ECU) 145 determines that the canister should be purged, the ECU opens the purge valve 140, applying vacuum from the intake manifold 150 to the canister 120. Outside air is drawn from the vent 130 through the charcoal medium in the canister 120, purging the charcoal of accumulated hydrocarbons. The gaseous mixture passes through the valve 140, through the intake manifold 150 and into the engine 160, where the purged hydrocarbons combust with fuel from a fuel injection system (not shown). The ECU 145 may regulate the opening of the valve 140 to accommodate various engine conditions, ambient outside air conditions and other factors. The ECU may receive information from sensors such as an exhaust gas oxygen sensor (not shown) and regulate the purge valve to maintain stoichiometric proportions in the engine combustion chambers.

For the ECU to control canister purge flow without extensive custom programming, the canister purge valve must have a reasonably linear response over its duty cycle. For example, flow should start upon application of a threshold operating current, and flow should increase approximately linearly with the application of increasing operating current. The approximately linear operating characteristics should be maintained over a range of pressure differentials across the valve, so that there is a predictable purge flow response over the expected range of intake manifold vacuum pressures.

Certain engine designs have inherently low intake manifold vacuum. Those engine designs include hybrid engines, multidisplacement engines and direct injection engines. In each of those cases, the low manifold vacuum, combined with the small flow path diameters typical of a canister purge valve as described above, provides insufficient purge flow to clean the canister.

Several solutions have been tried to solve the problem of insufficient canister purge resulting from low intake manifold vacuum. Some prior systems include multiple purge valves, or a large, heavy purge valve with increased port and sealing diameters. Those systems are more expensive to manufacture, and are difficult to validate in production. Such systems must be custom designed for each application, and cannot be easily added to an existing canister purge system design, further increasing manufacturing and development costs.

There is therefore presently a need for a method and system for providing a sufficient purge flow to remove adsorbed hydrocarbons from an adsorption canister in a vehicle fuel tank ventilation system, in cases where only low vacuum is available from the engine intake manifold. To the inventor's knowledge, no such method and system are currently available.

SUMMARY OF THE INVENTION

One embodiment of the present invention is a high flow purge valve apparatus for a fuel tank ventilation system. The ventilation system has an adsorption canister venting a fuel tank, and a canister purge valve connecting the canister to an intake manifold of an internal combustion engine. The high flow purge valve apparatus includes a nozzle connected between the canister purge valve and the adsorption canister, the nozzle having a pressure tap such that a purge flow from the adsorption canister to the canister purge valve creates low pressure in the pressure tap. The apparatus further includes a diaphragm-operated purge valve connecting the adsorption canister and the engine intake manifold, in parallel to the canister purge valve, a position of a diaphragm in the diaphragm-operated purge valve regulating a flow through the diaphragm-operated purge valve from the adsorption canister to the engine intake manifold; and a connecting passageway between the pressure tap and the diaphragm-operated purge valve, for applying the low pressure of the pressure tap to the diaphragm to change its position.

The adsorption canister may be an activated charcoal canister. The pressure tap may include a static pressure tube. That static pressure tube may be located at a throat section of the nozzle. The diaphragm-operated purge valve may be connected in parallel with the canister purge valve and the nozzle.

Another embodiment of the invention is a fuel tank ventilation system for venting vapors from a fuel tank. The ventilation system comprises an adsorption canister containing an adsorption medium, the canister communicating with the fuel tank for receiving vapors from the fuel tank, the adsorption canister being vented to atmosphere; a canister purge valve in communication with the adsorption canister, a nozzle in communication with the canister purge valve, the nozzle having a throat and a pressure tap at the throat whereby a gas flow through the nozzle creates vacuum in the pressure tap; the canister purge valve being operable to open and close a passageway from the canister through the canister purge valve and the nozzle to an intake manifold of an internal combustion engine; a vacuum-operated purge valve in communication with the adsorption canister and the engine intake manifold; and a connecting passageway between the pressure tap and the vacuum-operated purge valve, for operating the vacuum operated purge valve with the vacuum in the pressure tap.

The adsorption canister may contain a carbon adsorption medium. The pressure tap may include a static pressure tube, which may be located at a throat section of the nozzle. The vacuum-operated purge valve may be connected in parallel with the canister purge valve and the nozzle.

The vacuum-operated purge valve may comprise a diaphragm moveable by the vacuum; and a flow control valve linked to the diaphragm for operation thereby.

Another embodiment of the invention is a method for purging an adsorption canister for venting a fuel tank of an internal combustion engine. The method includes the steps of opening a canister purge valve to create a first purge flow from the adsorption canister to an intake manifold of the engine; generating a vacuum from the first purge flow; and opening a vacuum-operated purge valve with the generated vacuum to create a second purge flow from the adsorption canister to the intake manifold.

The step of generating a vacuum from the first purge flow may include the steps of passing the first purge flow through a nozzle; and tapping a low pressure region of the nozzle. The nozzle may be a sonic nozzle and the low pressure region of the nozzle may be a throat of the sonic nozzle.

The step of opening the canister purge valve may further comprise transmitting an electronic signal to the purge valve. A sum of the first and second purge flows may increase substantially linearly with an increasing electronic signal.

The first purge flow and the second purge flow may be parallel flows. The step of opening a vacuum-operated purge valve with the generated vacuum may further comprise subjecting a diaphragm to the generated vacuum, the diaphragm being operably connected to a valve mechanism.

The method may further include the step of regulating a flow rate of the second purge flow based on a level of the generated vacuum.

DESCRIPTION OF THE INVENTION

Figure 1:
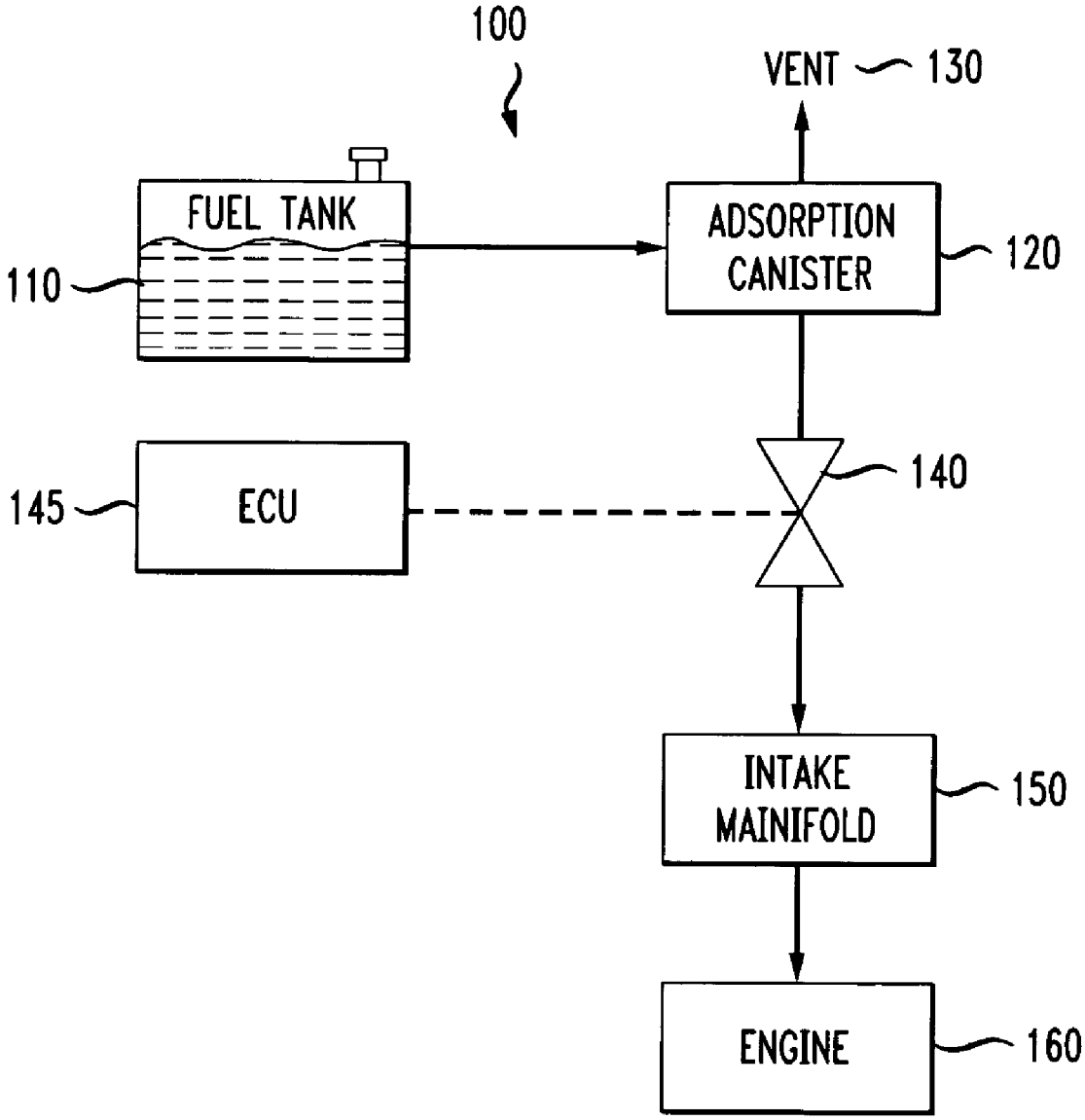
FIG. 1 PRIOR ART
FIG. 1 is a schematic illustration of a prior art fuel tank ventilation system.
Figure 2:
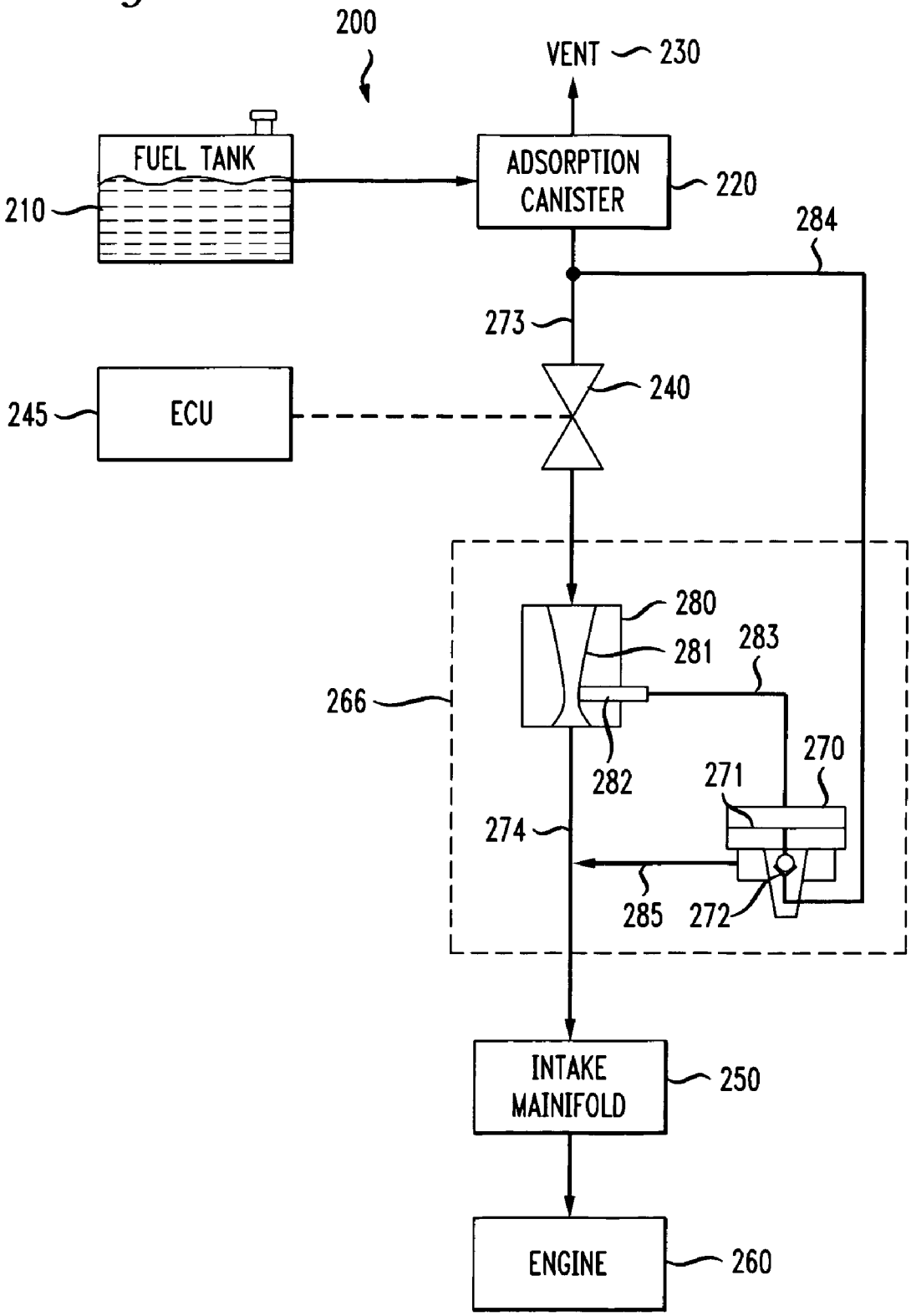
FIG. 2 is a schematic illustration of a fuel tank ventilation system according to one embodiment of the invention.

A fuel tank ventilation system 200 in accordance with one embodiment of the invention is shown schematically in FIG. 2. Elements corresponding to elements shown in FIG. 1 are indicated in FIG. 2 with element numbers indexed by 100. The fuel tank 210 is vented through an adsorption canister 220 to atmosphere through the vent 230. As in the arrangement described with reference to FIG. 1, during a purge cycle, a canister purge valve 240 is activated and controlled by an ECU 245, allowing the intake manifold 250 to draw outside air through the vent 230 and through the canister 220, purging accumulated hydrocarbons from the adsorption media in the canister. The purged hydrocarbons are combusted in the engine 260.

The present invention comprises a high flow, low vacuum purging system 266 that supplements the flow through the canister purge valve 240. A nozzle 280 is placed in the purge flow path 273, 274 between the canister purge valve 240 and the intake manifold 250. The nozzle is preferably a sonic nozzle (also known as a "critical flow venturi" or "critical flow nozzle") such as those commercially available and used for maintaining a constant flow rate with a pulsating or variable pressure on the downstream side of the nozzle. Other nozzles, such as a venturi or an ASME flow nozzle, may alternatively be used.

The nozzle 280 includes an interior surface 281 having a converging/diverging flow geometry. A pressure tap 282 is placed at the throat or point of minimum area along the nozzle. The pressure tap is preferably a static pressure tube. Due to the high flow velocity at the throat, a vacuum at the tap 282 is greater than the vacuum drawn by the intake manifold 250.

A connecting passageway or vacuum line 283 connects the tap 282 to a diaphragm operated valve 270. The diaphragm operated valve 270 inlcudes a diaphragm 271 that is operatively connected to a valve 272. The valve 272 permits flow in approximate proportion to the amount of vacuum in the passageway 283.

The diaphragm operated valve 270 controls flow in a passageway 284, 285 between the adsorption canister 220 and the intake manifold 250. The passageway 284, 285 is in parallel with the purge line 273, 274 through the canister purge valve 240; flow through the passageway 284, 285 therefore supplements the purge flow through passageway 273, 274.

In operation, the ECU 245 calls for the canister purge flow valve 240 to open, initializing flow from the vent 230, through the adsorption canister 220 to the intake manifold 250. That flow also passes through the nozzle 280, creating a vacuum at the throat of the interior surface 281, and in the pressure tap 282. The passageway 283 communicates that vacuum to one side of the diaphragm 271 of the valve diaphragm operated valve 270.

The diaphragm 271 is displaced by the vacuum, opening the valve 272 and starting flow through the parallel path 284, 285. That flow supplements the flow through the canister purge valve 240, permitting a higher total purge flow without requiring high intake manifold vacuum.

As the ECU 245 opens the canister purge valve 240 through its duty cycle, flow through the nozzle increases, also increasing the vacuum applied to the diaphragm 271. The system and method of the invention therefore allow proportional control of the purge flow rate without any additional sensors or electronics beyond what was originally required for the canister purge valve 240. The system is therefore suited for retrofitting an existing canister purge system in cases where intake manifold vacuum is low, such as in direct injection systems.

A feedback resonance may result from the valve 272 opening and closing in response to changes in vacuum in the passageway 283. The inventor has found that an increased length of the passageway 273 between its junction with the parallel passageway 284 and the canister purge valve 240 provides a damping effect that inhibits such resonance. Similarly, an increased length of the passageway 274 between its junction with the parallel passageway 285 and the nozzle 280 dampens such resonance.

Figure 3:
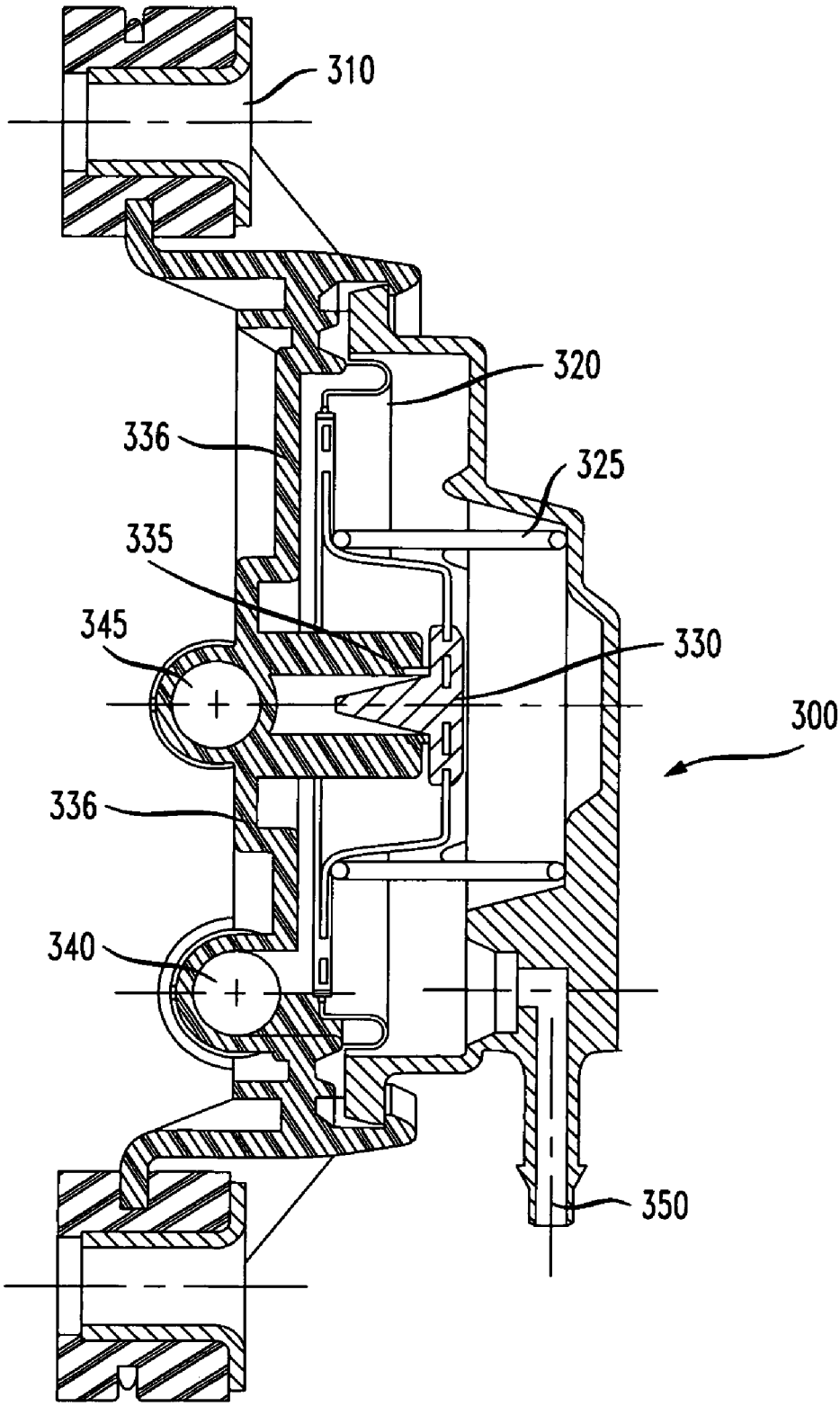
FIG. 3 is a cross-sectional view of a diaphragm operated purge valve according to one embodiment of the invention.

An exemplary diaphragm controlled valve 300 suitable for use in the present invention is shown in FIG. 3. The valve may be mounted in the vehicle using grommets 310. The valve includes a convoluted flexible diaphragm 320 having an elastomeric portion to permit movement in response to differential pressure across the diaphragm. Mounted on the diaphragm is a valve plunger 330 that mates with a sealing lip 335 formed integrally with the body 336 of the valve. The seal between the plunger 330 and the lip 335 blocks flow between the passage 340 and the passage 345.

Vacuum applied to a vacuum port 350 lowers pressure on one side of the diaphragm, causing it to move. The movement of the diaphragm causes displacement of the plunger 330 from the lip 335. Flow is thereby permitted between the passage 345 and the passage 340. A spring 325 biases the diaphragm 320 and the plunger 330 to a closed position.

Figure 4:
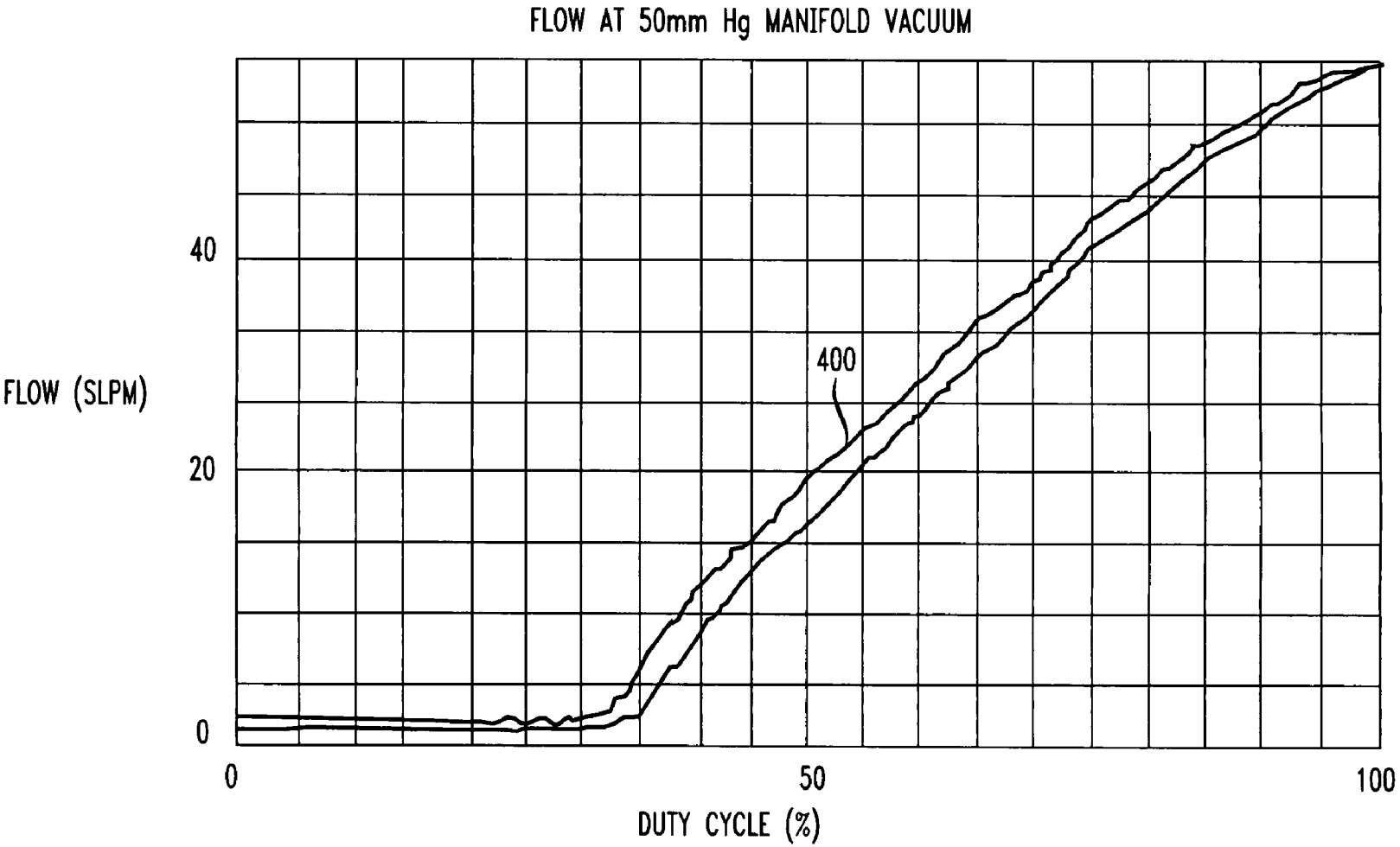
FIG. 4 is a chart showing purge flow rate at various duty cycles of the canister purge valve, measured in a prototype system according to the invention under 50 mm Hg manifold pressure.
Figure 5:
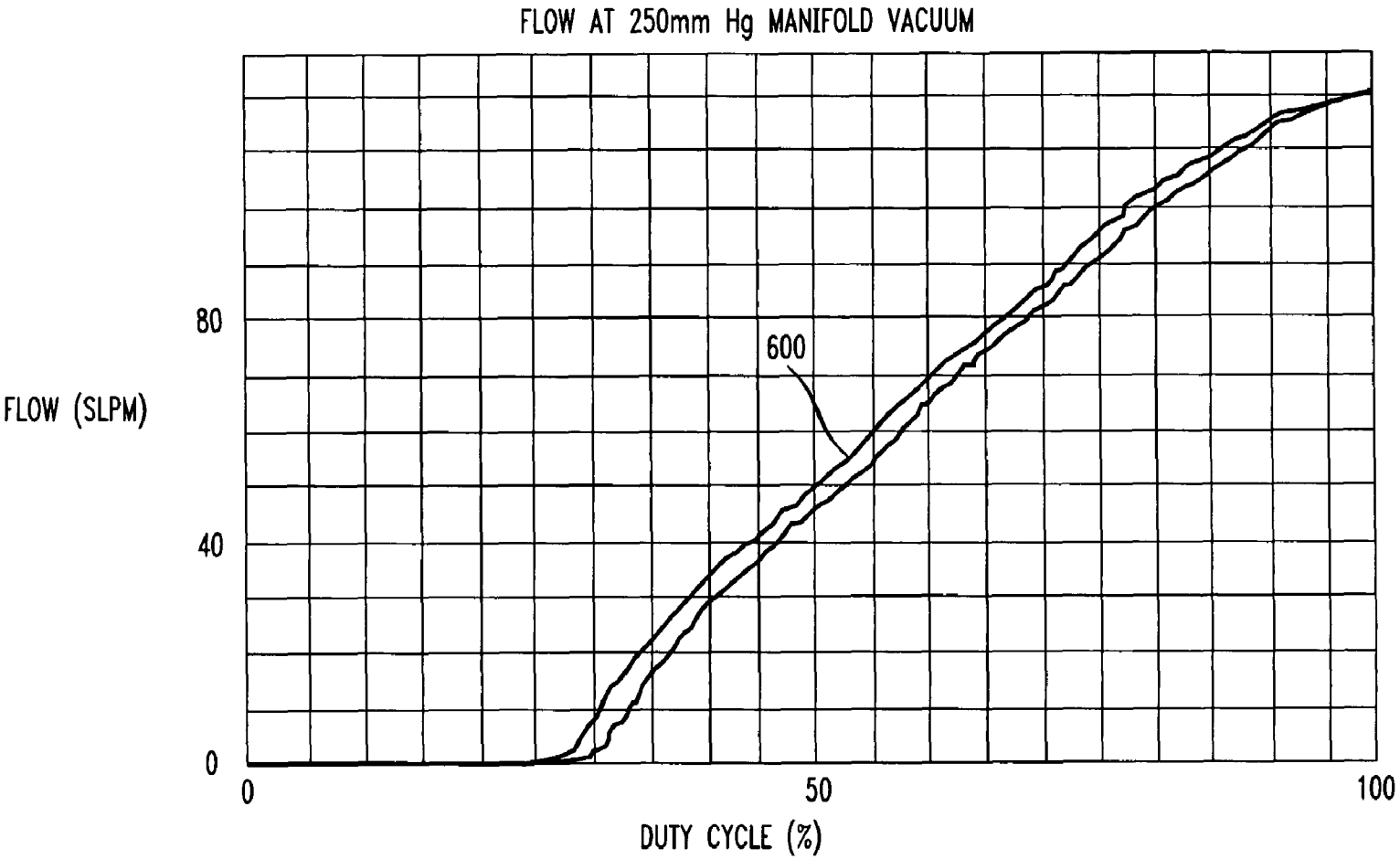
FIG. 5 is a chart showing purge flow rate at various duty cycles of the canister purge valve, measured in a prototype system according to the invention under 250 mm Hg manifold pressure.
Figure 6:
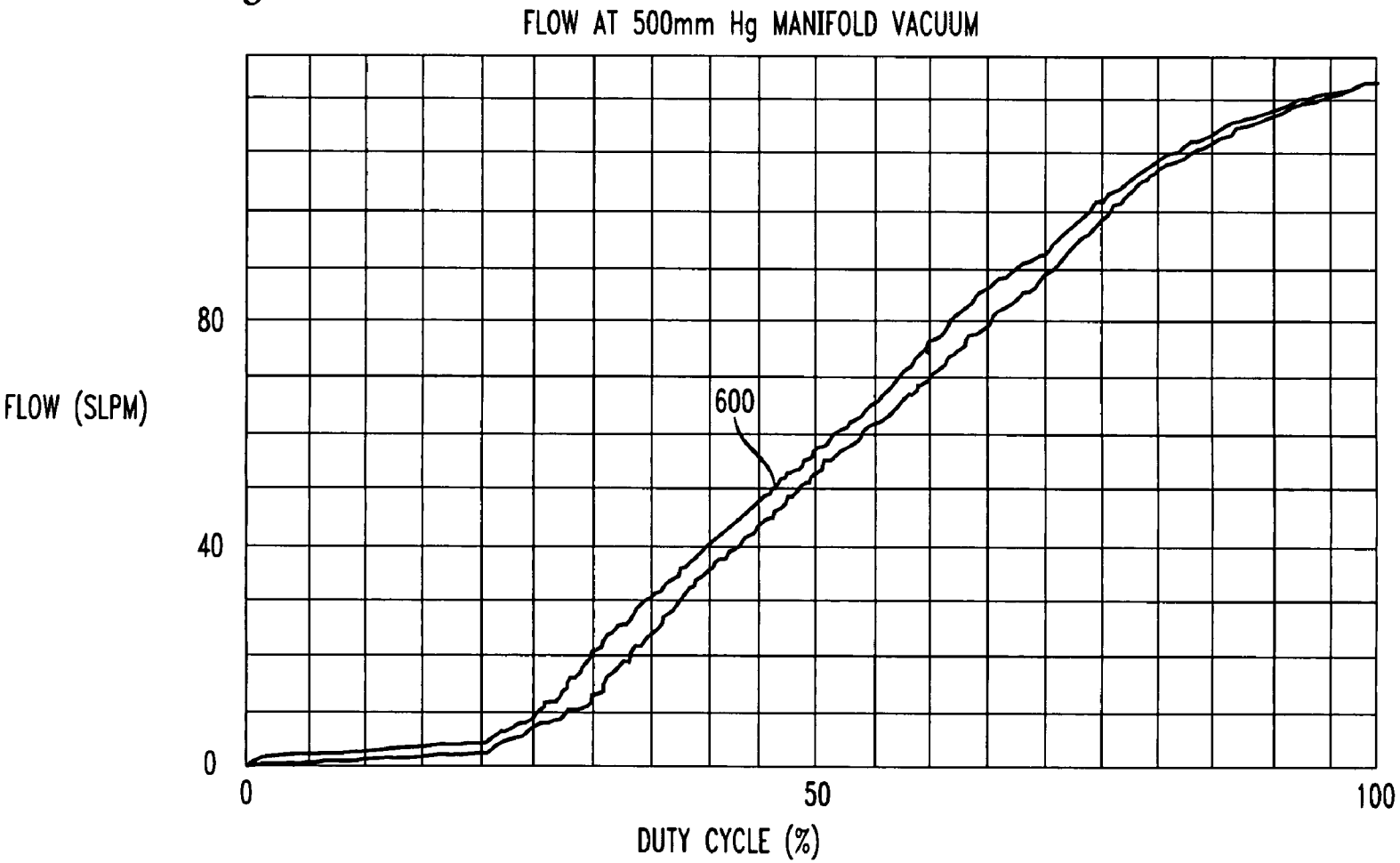
FIG. 6 is a chart showing purge flow rate at various duty cycles of the canister purge valve, measured in a prototype system according to the invention under 500 mm Hg manifold pressure.

The plots shown in FIGS. 4, 5 and 6 were generated by testing a prototype system according to the present invention. Each of the traces 400, 500, 600 shown in those figures demonstrates a substantially linear relationship between percent duty cycle applied to the canister purge valve, and total purge flow through the canister.

For example, the plot 400 of FIG. 4 shows that at a manifold pressure of 50 mm Hg, flow begins at about 32% duty cycle, and flow increases in a substantially linear manner with increased current applied to the canister purge valve. "Substantially linear," as used herein, means that a given current input results in a flow output predictable as a linear function within about plus or minus 15%. A system such as the inventive system may be controlled using a simple linear control algorithm, without the additional complexity of non-linear control.

The traces 400, 500, 600 were made at three different manifold vacuum pressures, demonstrating the effectiveness of the invention over a range of manifold pressures. In each case, it can be seen that the flow response begins at an initial offset percentage of duty cycle, and continues in a substantially linear manner to close to its maximum value.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, while the system is disclosed herein with respect to use in an automotive fuel ventilation system, the system and method of the invention may be used in other fields where relatively high flow and linear response are required in a system having relatively low vacuum. It is to be understood that the embodiments shown and described herein are only illustrative of the principles of the present invention and that various modifications may be implemented by those skilled in the art without departing from the scope and spirit of the invention.

What is claimed is:

1. A high flow purge valve apparatus for a fuel tank ventilation system having an adsorption canister venting a fuel tank, and a canister purge valve connecting the canister to an intake manifold of an internal combustion engine, the high flow purge valve apparatus comprising:

a nozzle connected between the canister purge valve and the intake manifold, the nozzle having a pressure tap such that a purge flow from the canister purge valve to the intake manifold creates low pressure in the pressure tap;

a diaphragm-operated purge valve connecting the adsorption canister and the engine intake manifold, in parallel to the canister purge valve, a position of a diaphragm in the diaphragm-operated purge valve regulating a flow through the diaphragm-operated purge valve from the adsorption canister to the engine intake manifold; and a connecting passageway between the pressure tap and the diaphragm-operated purge valve, for applying the low pressure of the pressure tap to the diaphragm to change its position.

2. The apparatus of claim 1, wherein the adsorption canister is an activated charcoal canister.

3. The apparatus of claim 1, wherein the pressure tap comprises a static pressure tube.

4. The apparatus of claim 3, wherein the static pressure tube is located at a throat section of the nozzle.

5. The apparatus of claim 1, wherein the diaphragm-operated purge valve is connected in parallel with the canister purge valve and the nozzle.

6. A fuel tank ventilation system for venting vapors from a fuel tank, comprising:

an adsorption canister containing an adsorption medium, the canister communicating with the fuel tank for receiving vapors from the fuel tank, the adsorption canister being vented to atmosphere;

a canister purge valve in communication with the canister;

a nozzle in communication with the canister purge valve, the nozzle having a throat and a pressure tap at the throat whereby a gas flow through the nozzle creates vacuum in the pressure tap; the canister purge valve being operable to open and close a passageway from the adsorption canister through the canister purge valve and the nozzle to an intake manifold of an internal combustion engine;

a vacuum-operated purge valve in communication with the adsorption canister and the engine intake manifold; and a connecting passageway between the pressure tap and the vacuum-operated purge valve, for operating the vacuum operated purge valve with the vacuum in the pressure tap.

7. The system of claim 6, wherein the adsorption canister contains a carbon adsorption medium.

8. The system of claim 7, wherein the pressure tap comprises a static pressure tube.

9. The system of claim 8, wherein the static pressure tube is located at a throat section of the nozzle.

10. The system of claim 7, wherein the vacuum-operated purge valve is connected in parallel with the canister purge valve and the nozzle.

11. The system of claim 7, wherein the vacuum-operated purge valve comprises:

a diaphragm moveable by the vacuum; and a flow control valve linked to the diaphragm for operation thereby.

12. A method for purging an adsorption canister for venting a fuel tank of an internal combustion engine, the method comprising the steps of:

opening a canister purge valve to create a first purge flow from the adsorption canister to an intake manifold of the engine;

generating a vacuum from the first purge flow; and opening a vacuum-operated purge valve with the generated vacuum to create a second purge flow from the adsorption canister to the intake manifold.

13. The method of claim 12, wherein the step of generating a vacuum from the first purge flow comprises the steps of passing the first purge flow through a nozzle; and tapping a low pressure region of the nozzle.

14. The method of claim 13, wherein the nozzle is a sonic nozzle and the low pressure region of the nozzle is a throat of the sonic nozzle.

15. The method of claim 12, wherein the step of opening the canister purge valve further comprises:

transmitting an electronic signal to the purge valve.

16. The method of claim 15, wherein a sum of the first and second purge flows increase substantially linearly with an increasing electronic signal.

17. The method of claim 12, wherein the first purge flow and the second purge flow are parallel flows.

18. The method of claim 12, wherein the step of opening a vacuum-operated purge valve with the generated vacuum further comprises:

subjecting a diaphragm to the generated vacuum, the diaphragm being operably connected to a valve mechanism.

19. The method of claim 12, further comprising the step of:

regulating a flow rate of the second purge flow based on a level of the generated vacuum.

* * * * *